US007117980B2

(12) United States Patent
Wyss et al.

(10) Patent No.: US 7,117,980 B2
(45) Date of Patent: Oct. 10, 2006

(54) METHOD AND APPARATUS FOR CONTROLLING AN ELEVATOR INSTALLATION WITH ZONING AND AN INTERCHANGE FLOOR

(75) Inventors: Philipp Wyss, Root (CH); Miroslay Kostka, Ballwil (CH)

(73) Assignee: Invento AG, Hergiswil (CH)

( * ) Notice: Subject to any disclaimer, the term of this patent is extended or adjusted under 35 U.S.C. 154(b) by 222 days.

(21) Appl. No.: 10/875,412

(22) Filed: Jun. 24, 2004

(65) Prior Publication Data

US 2004/0262092 A1 Dec. 30, 2004

(30) Foreign Application Priority Data

Jun. 27, 2003 (EP) ..... 03405473

(51) Int. Cl.
*B66B 1/20* (2006.01)

(52) U.S. Cl. ..... 187/383; 187/247

(58) Field of Classification Search ..... 187/380–389, 187/247, 248

See application file for complete search history.

(56) References Cited

U.S. PATENT DOCUMENTS 4,838,385 A 6/1989 Ekholm
5,020,642 A * 6/1991 Tsuji ..... 187/382
5,719,360 A * 2/1998 Davis et al. ..... 187/383
5,773,772 A * 6/1998 McCarthy et al. ..... 187/289
6,871,727 B1 * 3/2005 Jokela et al. ..... 187/383
2003/0000776 A1 1/2003 Kostka
2005/0077115 A1 * 4/2005 Urata ..... 187/383
2005/0087402 A1 * 4/2005 Haegi et al. ..... 187/383

FOREIGN PATENT DOCUMENTS

EP 0 891 291 1/1999

* cited by examiner

*Primary Examiner*—Jonathan Salata
(74) *Attorney, Agent, or Firm*—Butzel Long

(57) ABSTRACT

An elevator installation control method with zoning provides changes between zones at an interchange floor. Transportation to or from the interchange floor is by at least one feeder-elevator group and at least one connecting-elevator group. The feeder-elevator group has several feeder elevators that travel in a first zone below the interchange floor and the connecting-elevator group has several connecting elevators that travel in a second zone above it. Trip destinations are entered via destination-call input and the feeder-elevator group and the connecting-elevator group are combined into a multigroup that is controlled by a multigroup control. To optimize the elevator installation operation and utilization, the multigroup control allocates a feeder elevator depending on the number of trip destinations in the first zone to be traveled to by this feeder elevator and/or on the number of trip destinations in the second zone.

18 Claims, 4 Drawing Sheets

METHOD AND APPARATUS FOR CONTROLLING AN ELEVATOR INSTALLATION WITH ZONING AND AN INTERCHANGE FLOOR

BACKGROUND OF THE INVENTION

The present invention relates to a method for controlling an elevator installation operated with zoning in which changing between zones is made possible at an interchange floor and in which with at least one feeder-elevator group and at least one connecting-elevator group transportation to or from the interchange floor is realized. The at-least one feeder-elevator group comprises in each case several feeder elevators which travel to a first zone below an interchange floor and to the interchange floor. The at-least one connecting-elevator group comprises in each case several connecting elevators which travel to the interchange floor and to the floors of a second zone located above it. The trip destinations are input via a destination-call input. The feeder-elevator group and the connecting-elevator group are combined into a multigroup, which is controlled by a multigroup control. The present invention also relates to an elevator installation with several elevator groups having a destination-call control in buildings.

For the increasing requirement for transportation in tall buildings, intelligent elevator controls are used. For this purpose, the building is divided vertically into two or more zones or floor ranges. In each of these zones one or more elevator groups can realize transportation, especially of passengers. When there are many floors, vertical transportation often requires changing from a first elevator into another elevator. In this case, the first elevator used is a feeder elevator of a feeder-elevator group that transports the passengers to floors of a first zone and to an interchange floor. The interchange floor between the zones is also referred to as a sky lobby. Adjoining the interchange floor is the second zone. At the interchange floor passengers with trip destinations in the second zone change to a connecting elevator of a connecting-elevator group. A trip that requires changing from the feeder-elevator group to the connecting-elevator group is referred to as an interchange trip. By contrast, a trip whose destination is reachable without an interchange is referred to as a direct trip. However, as soon as a high amount of traffic to the higher range of floors with an interchange is necessary, queues may form on the interchange floor. These are caused mainly by unequal transportation capacities between the feeder-elevator group and the connecting-elevator group but also by uncontrolled direction of interchanging passengers in the feeder elevator.

In very high buildings, elevators occupy a significant part of the cross-section of the building. Since the available space on the interchange floors is usually limited, the space problem on the interchange floor cannot be solved without comparatively high constructional and financial outlay.

With conventional "two-button controls" there is usually no transportation-optimizing connection between the feeder-elevator group and the connecting-elevator group. Solutions are indeed known, for example to synchronize the arrival time of the feeder elevator and of the connecting elevator, but these have various disadvantages. Thus, the more realistic variant is delay of the feeder elevator because an earlier arrival time of the connecting elevator by dynamically changing the acceleration and/or speed or shortening the door-opening time is either technically impossible (electrical performance, traffic density, etc.) or contra-productive for traffic optimization (skipping stops).

Furthermore, the conventional control offers no means of early recognition of the need for an interchange trip, so that no effective measures for simplification of the interchange process are possible.

Described in the European patent EP 0 891 291 B1 is a control for several elevator groups in which several destination-call controls are combined into a multigroup control, the multigroup control selecting from all possible elevators of all elevator groups the lowest-cost elevator. This solution aims to allocate one elevator from several elevator groups, input of a destination-call being utilized to allocate the lowest-cost elevator for the desired trip in such a manner that the passenger is transported to his/her destination by the most direct route possible.

However, the disadvantage of the solutions with destination-call controls hitherto is that allocation of the interchanging passengers in the first feeder elevator used takes place irrespective of the final destinations of the individual passengers and the number of final destinations. For this reason it is possible for a feeder elevator to be transporting only passengers all of whose trip destinations are in a second zone but that each passenger wants to leave the elevator at a different floor in the second zone. This uncontrolled allocation requires elaborate and sometimes unclear signaling of the connecting elevators. Also with the solutions hitherto, it is not possible to direct the passengers to the feeder elevators in such manner that the passengers of a certain feeder elevator can change to the same connecting elevator which travels to only a limited number of trip destinations. With the methods of control known hitherto it is possible for passengers with mutually exclusive characteristics, for example opposite directions of travel of the connecting elevator, meaning distribution of the passengers from the interchange floor in upward and downward direction, to be allocated the same feeder elevator. The number of interchanging passengers with different trip destinations in the feeder elevator and in the connecting elevator could not hitherto be restricted to a reasonable number.

SUMMARY OF THE INVENTION

The purpose of the present invention is therefore to propose an elevator installation and a method of controlling the elevator installation by means of which the process of interchange from the feeder elevator to the connecting elevator is optimized and an inexpensive utilization of the elevator installation is made possible. It is especially the purpose to reduce the round-trip times of the elevators and the travel time of the passengers.

The problems and shortcomings of elevator controls according to the state of the art are solved according to the present invention by a method of controlling an elevator installation operated with zoning in which, on an interchange floor, changing between zones is made possible and in which transportation to or from the interchange floor is realized with at least one feeder-elevator group and at least one connecting-elevator group. The method according to the present invention also foresees that the at-least one feeder-elevator group comprises in each case several feeder elevators, which travel to a first zone below an interchange floor and to the interchange floor and that the at-least one connecting-elevator group comprises in each case several connecting elevators which travel to the interchange floor and to the floors of a second zone which are located above it. Furthermore, the trip destinations are entered via a destination-call input and the feeder-elevator group and the connecting-elevator group are combined into a multigroup that is controlled by a multigroup control. By means of the input destination-call the multigroup control allocates a feeder elevator depending on the number of trip destinations of the feeder elevator in the first zone and/or depending on the number of trip destinations in the second zone of the passengers allocated to a feeder elevator.

Underlying the present invention is the idea of utilizing the information gained from input of the destination call as soon as possible to optimize the travel time. With the embodiment according to the present invention an efficient interchange management is thereby made possible, with the result that the round-trip times of the elevators are shortened and therefore the overall travel time of the interchanging passengers is optimized. Furthermore, clear signaling and direction for the interchanging passengers is made possible.

In a preferred embodiment, on allocation of a feeder elevator the number of passengers with different trip destinations in the first zone is limited, the number of intermediate stops between a boarding floor and the interchange floor being registered and compared with a parameter for the maximum number of intermediate stops of the feeder elevator, and a feeder elevator only being allocated if the number of intermediate stops of the feeder elevator is less than the parameter for the maximum number of intermediate stops. It is thereby made possible for a feeder elevator to not need to stop at many floors of the first zone. On the other hand, transportation capacity is left free in the respective feeder elevator for travel to the floors of the second zone, which would be less if many passengers with all possible destinations in the first zone were allocated to the feeder elevator.

In a further embodiment of the present invention, on allocation of a feeder elevator the number of passengers with different trip destinations in the second zone is limited, the number of different destination floors in the second zone of the passengers allocated to the feeder elevator being registered and compared with a parameter for different destinations in the second zone and a feeder elevator only being allocated if the number of different destination floors in the second zone of the feeder elevator is less than the parameter for the different trip destinations in the second zone. By this means it is made possible for only a limited number of interchanging passengers with different trip destinations to be transported in one feeder elevator. Thus, for example, the number of passenger groups with different destination floors in the second zone can be limited to two, so that on the interchange floor only two groups of interchange passengers leave this feeder elevator, and signaling of the connecting elevators remains correspondingly simple, and mixing of all interchange passengers on the interchange floor is strategically prevented.

In a further development of the present invention, the number of allocatable connecting elevators on the interchange floor is limited to a parameter for the maximum allocatable connecting elevators. By this means, mixing of the interchanging passengers on the interchange floor is very largely prevented.

In a further development of the present invention, on allocation of the connecting elevator the number of destinations of the respectively allocated connecting elevator is limited, the number of destinations in the connecting elevator being registered and compared with a parameter for the maximum number of destinations of the connecting elevator, a connecting elevator only being allocated if the number of destinations in the connecting elevator is less than the predetermined parameter for the maximum number of destinations of the connecting elevator. This has the advantage that continuation of travel with the connecting elevators is not prolonged by very many intermediate stops in the second zone Z2 and an optimal travel time is thereby achieved.

In a further development of the present invention, on allocation of the feeder elevator the number of interchanging passengers can be limited.

In a further development of the present invention, the multigroup control is influenced by means of a special-status button so that on allocation of the feeder elevators and the connecting elevators a longer or shorter interchange time for passengers with special status can be taken into account.

Advantageously, provision is also made for signaling the connecting elevator to be selected in the feeder elevator. By this means, the interchange passengers already know before disembarking at the interchange floor with which connecting elevator they must continue to travel and in which direction they must walk, and when or in how many seconds or minutes the connecting elevator will depart.

The purpose is further solved by an elevator installation with several elevator groups with destination-call control in buildings, which comprises at least one feeder-elevator group with several feeder elevators and at least one connecting-elevator group with several connecting elevators. The feeder elevators of the feeder-elevator group travel to a first zone of the building and the connecting elevators of the connecting-elevator group travel to a second zone of the building. The elevator groups also travel to at least one common interchange floor. Furthermore, the elevator installation has display devices to display the elevator to be selected and a multigroup control to control the feeder-elevator group and the connecting-elevator group. After input of a first destination call, the lowest-cost feeder elevator may be selected from the feeder-elevator group depending on a parameter for a maximum number of trip destinations of the feeder elevator in the first zone and/or of a parameter for a maximum number of trip destinations in the second zone.

It is assumed that the knowledgeable reader recognizes that feeder-elevator groups and connecting-elevator groups can be exchanged depending on the direction of travel. Also depending on the direction of travel, the sequence of the zones used can be exchanged. Thus, for example, when traveling from above to below, the second zone is the first zone to be used. To ensure greater clarity and comprehensibility, in what follows the present invention is described only in relation to the direction of travel from above to below in the building, so that the first zone is the lower zone and the second zone is the upper zone. Furthermore, the invention can easily be transferred to several elevator groups, the number of parameters to be monitored regarding the maximum number of trip destinations in the individual zones then, however, increasing.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
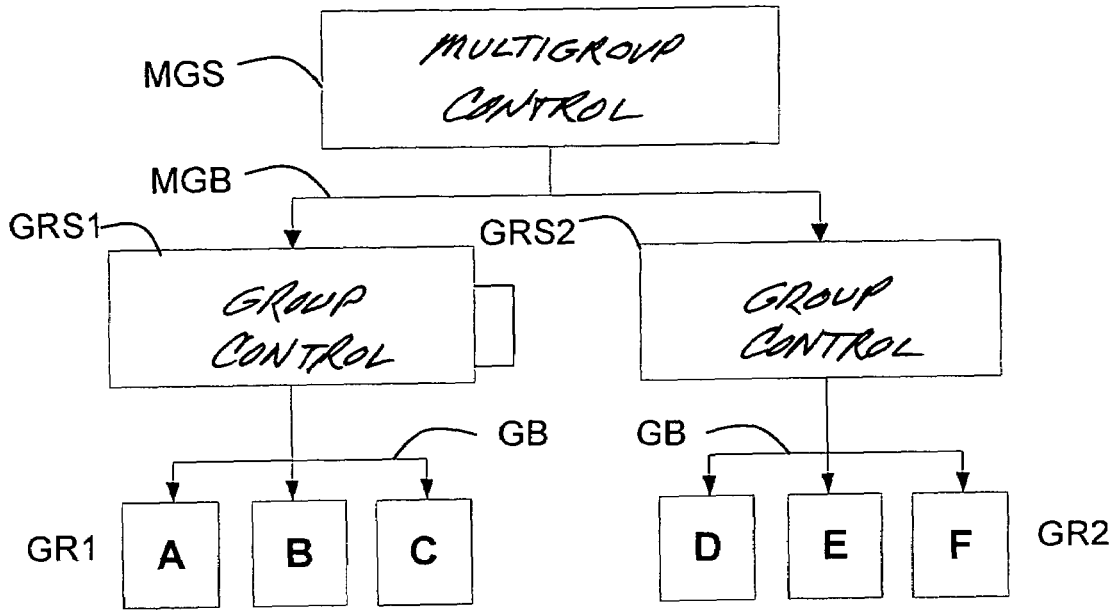
FIG. 1 is a schematic block diagram of the structure of a multigroup control in an elevator installation according to the present invention.
Figure 2:
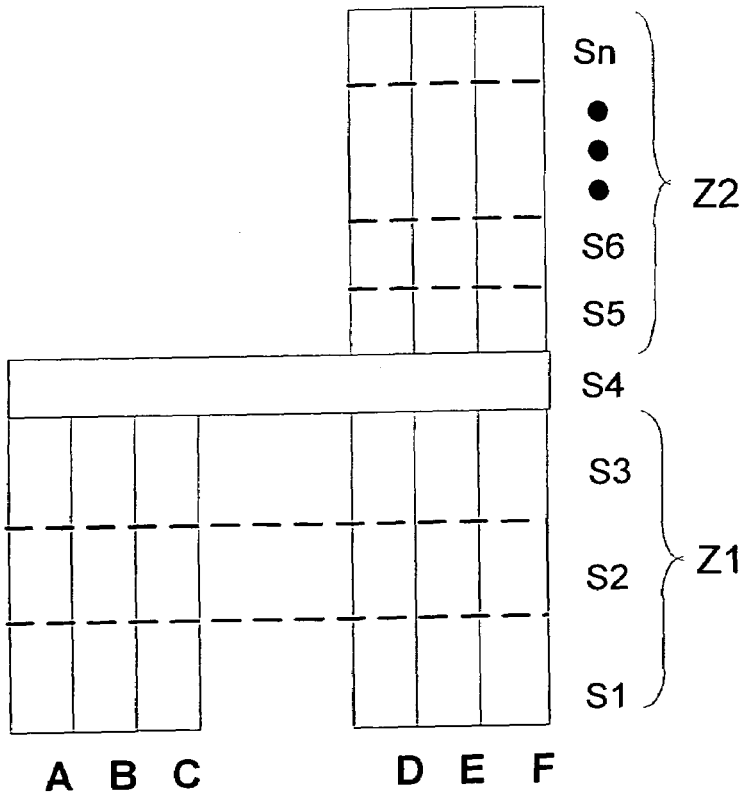
FIG. 2 is a schematic representation of a subdivision of a building into several zones.

In FIG. 1 a diagrammatic structure of an elevator installation is represented in schematic form. Especially shown is the combination of two elevator groups into a multigroup with a multigroup control. The individual elevators are designated with the letters A through F, the elevators A to C being combined into a feeder-elevator group GR1 which travels to a first, or lower in a vertical direction, zone Z1 (FIG. 2) of a building. As shown in FIG. 2, floors S1 through S3 of the first zone Z1 are located below an interchange floor S4. The elevators D to F form a connecting-elevator group GR2 and travel as well as to the interchange floor S4 also to the second zone Z2 above the interchange floor S4. A superordinated multigroup control MGS is arranged centrally in a separate computer or in one or in all of group controls GRS1, GRS2. The multigroup control MGS is connected via a multigroup bus MGB with the group controls GRS1 and GRS2. The group controls GRS1 and GRS2 are connected via group buses GB to the elevator groups GR1 and GR2 and therefore to the elevators A through F.

In FIG. 2, the subdivision of a building with an elevator installation operated in zones is illustrated. The first zone Z1 situated lower in the vertical direction comprises the floors S1 to S3, it being possible for it also to include further lower floors which are not shown. In the example described below, the floor S1 is the boarding floor. The first, or lower, zone Z1 and the interchange floor S4 are served essentially by the feeder-elevator group GR1. Adjoining above the interchange floor S4 is the second or upper zone Z2 that comprises the floors S5 through Sn. These floors S5–Sn and the interchange floor S4 are traveled to by the interchange-elevator group GR2 with the elevators D–F. It is possible for the connecting-elevator group with the elevators D–F to travel additionally to the boarding floor S1, but apart from this, however, no trip destination in the lower zone Z1 is reachable with the connecting-elevator group GR2.

Figure 3:
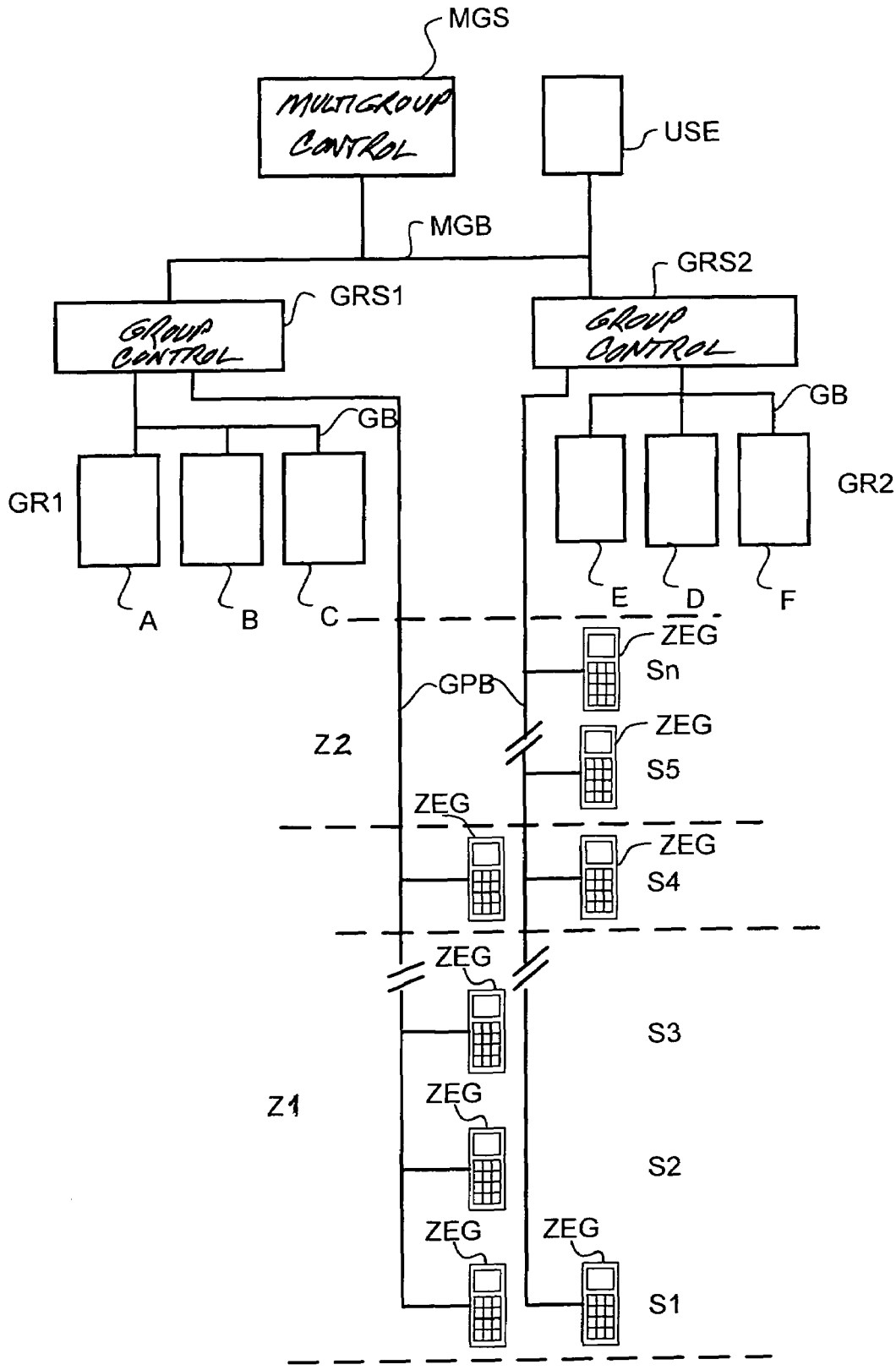
FIG. 3 is a schematic block diagram of a detailed structure of an elevator installation according to the present invention.

Shown in FIG. 3 is a detailed structure of the elevator installation according to the present invention. The building comprises the zones Z1 and Z2. The elevators A–F are divided into the elevator groups GR1 and GR2 and are called from a plurality of destination-call control devices ZEG. Via a group peripheral bus GPB the individual floors S1-Sn are connected to the group controls GRS1 and GRS2. Arranged to control the elevator installation is the multigroup control MGS to which an interchange control unit USE is connected. From the feeder-elevator group GR1 and the connecting-elevator group GR2 a multigroup is formed. By means of the destination-call control the multigroup control MGS recognizes how many of the passengers must interchange on the interchange floor S4 or can reach their trip destination with a direct trip. The multigroup control MGS determines the feeder elevator A, B, C, and communicates to the passengers the first feeder elevator A, B, C to be used.

Figure 4:
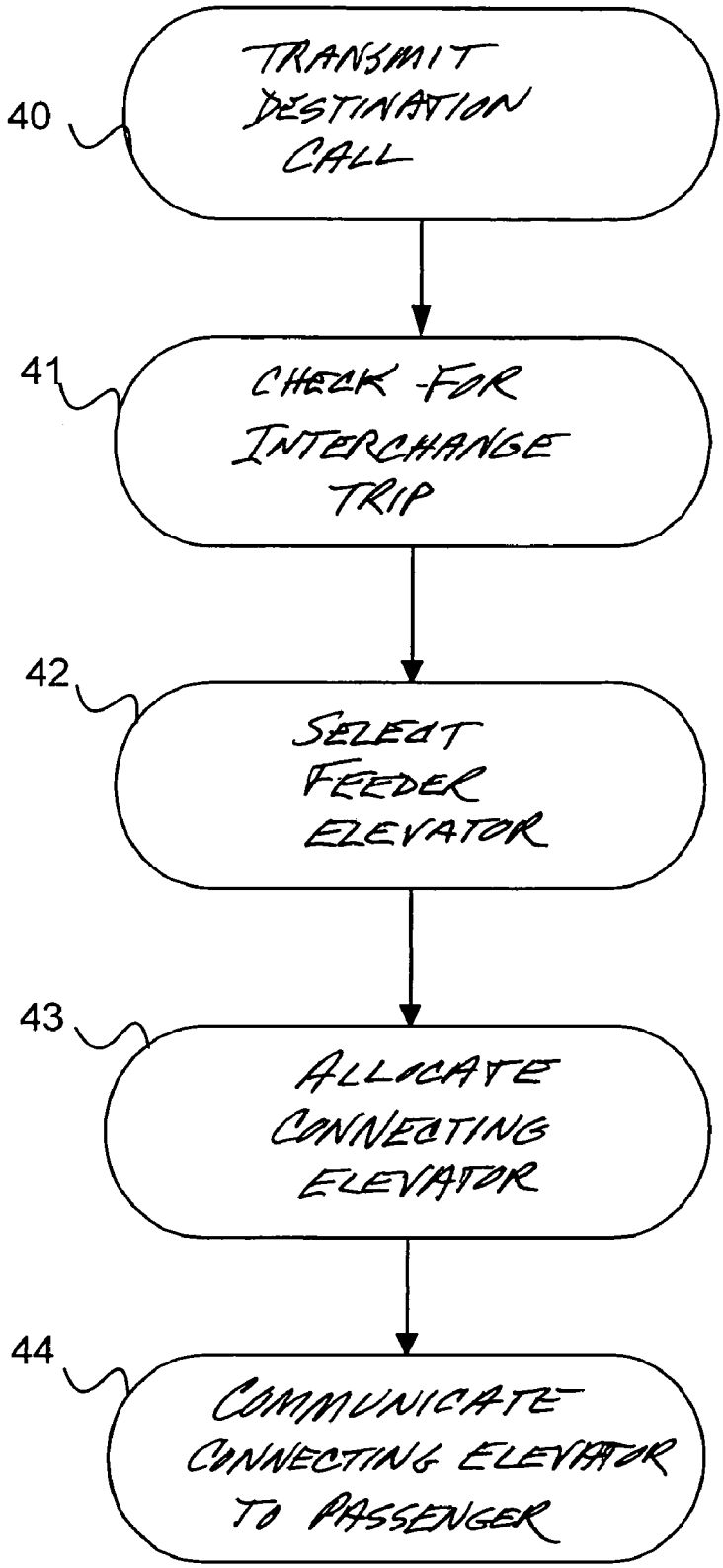
FIG. 4 is a flow chart of the allocation of a feeder elevator and the allocation of a connecting elevator according to the present invention.

In FIG. 4 a simplified procedure for allocating a feeder elevator is shown. In a step 40 a destination call, for example via the destination-call input devices ZEG or a card reader, is transmitted to the multigroup control MGS. In a step 41 the latter checks whether the destination call is for an interchange trip. Depending on this result, a one of the feeder elevators A, B, C is selected (step 42). However, it is also possible for an elevator from the connecting-elevator group GR2 to be used as the feeder elevator, since the elevators D–F in this exemplary embodiment also travel to the boarding floor S1. These elevators D–F then travel directly to the interchange floor S4, so that even with a connecting elevator of this type an interchange trip is possible. After the feeder elevator has been allocated, while it is traveling to the interchange floor S4 a connecting elevator is allocated (step 43) based on the trip destinations of the passengers allocated to this feeder elevator. The connecting elevator(s) allocated for the passengers in the respective feeder elevator is/are communicated via a display device (step 44), a voice announcement of the connecting elevators also being possible.

Figure 5:
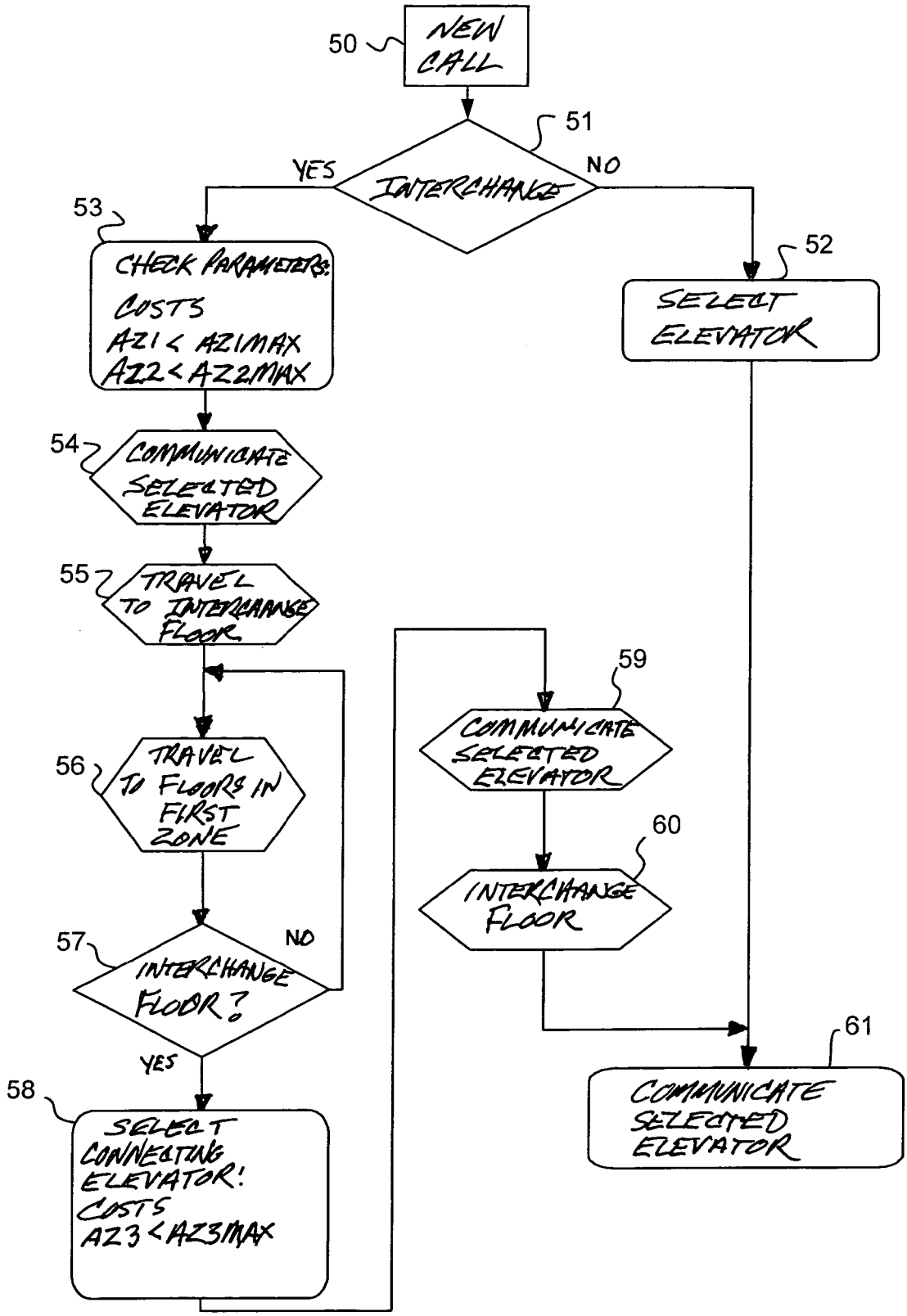
FIG. 5 is a detailed flow chart of the allocation of a feeder elevator and the allocation of a connecting elevator according to the present invention.

FIG. 5 shows a detailed procedure for the allocation, especially showing the criteria according to which a one of the feeder elevators A, B, C is allocated. First, a new destination call is entered by a passenger (step 50). The call is checked for whether it relates to a trip destination that requires an interchange (step 51). If an interchange is necessary, in step 53 several parameters are interrogated. For the zone Z1 a number "AZ1" of intermediate stops at the floors S2, S3 between the boarding floor and the interchange floor S4 are checked and compared with a parameter "AZ1MAX". Only when the number "AZ1" of intermediate stops up to the interchange floor S4, including the selected trip destination, is less than the parameter "AZ1MAX", can this feeder elevator A or B or C be allocated to the passenger. If for the first feeder elevator of multigroup MGS which is checked, for example A, the number "AZ1" is already greater than the parameter "AZ1MAX", this feeder elevator A cannot be allocated. The multigroup control MGS then checks the next possible feeder elevator B and then the feeder elevator C.

If the first condition is fulfilled, a number of destination floors "AZ2" in the upper zone Z2 of the interchange passengers booked for the feeder elevator A, B, C, including the selected trip destination, is determined and compared with a parameter "AZ2MAX". If the number "AZ2", including the destination floor, reaches the parameter "AZ2MAX", the feeder elevator checked by the multigroup control MGS, for example A, cannot be allocated for the passenger. In this case, the feeder elevator with the next lowest costs is checked and if suitable, is allocated. Furthermore, the allocation is performed under the aspect of cost optimization as described in, for example, European patent document EP 0 301 173 A1 (optimization of operating costs). In a step 54, the feeder elevator to be selected is communicated to the passenger on the boarding floor S1 via a display device, for example on the destination-call input device ZEG. The travel to the interchange floor S4 than takes place (step 55). During the travel to the interchange floor S4 the floors S2 and S3 located in the first zone Z1 can be traveled to (step 56). Before the interchange floor S4 is reached (step 57), a connecting elevator D–F is selected (step 58). When allocating the connecting elevator D, E, F, as well as optimization of the costs, the following condition is added: Only if a number of destinations "AZ3" of the connecting elevator, including all the destinations of the passengers boarding or changing to this connecting elevator, is less than a parameter "AZ3MAX" can an elevator be determined and allocated as connecting elevator. Otherwise, the elevator with the next lowest costs is checked and allocated if suitable. In a next step 59, the connecting elevator to be used is already communicated to the passengers in the feeder elevator. In a step 60, leaving the elevator or changing to the connecting elevator takes place on the interchange floor S4. If there is no interchange travel, for example in the case of a direct travel to floor S2 or S3, or use of the connecting-elevator group GR2 for other higher-level floors S5-Sn, the elevator is selected which can reach this trip destination directly (step 52) and the elevator to be used is signaled normally (step 61).

The foregoing conditions take account of the longer interchange travel and enable clear and comprehensible information about the connecting elevators D–F which is already communicated to the interchanging passengers present in the feeder elevator by display devices during the feeder trip.

For the passengers in a feeder elevator A, B, C, a number "AAZ" of allocatable connecting elevators D, E, F is limited to an automatically controlled maximum of, for example, one or two elevators even if the destination floors are different. This makes the transmission of information in the form of a display or voice announcement in the feeder elevator arriving at the interchange floor S4 simpler and easy to understand. Through this deliberate simplification of the information the probability is reduced of one of the passengers missing the connecting elevator. It is thus made possible that passengers from one feeder elevator need change into not more than two different connecting elevators so that the transmission of information remains simple and the passenger flows on the interchange floor do not mix too intensively.

The basis for this simplified information about the connecting elevator is the limitation of the stops that can be allocated to a feeder elevator A, B, C as stated at the outset. Furthermore, the time available for changing is calculated by the multigroup control MGS. This time results, for example, from the number of all interchanging passengers, each interchanging passenger being assigned a time unit of, for example, one second. For older passengers or those with walking impairments this time unit can be chosen to be longer. Furthermore, the time for the approach distance from the feeder elevator to the connecting elevator and a selectable reserve time are added to it. A possible waiting time for the connecting elevator can also be added to it. Thus, each interchange passenger in the feeder elevator can be given the corresponding information for each allocated connecting elevator, for example destination floor S35, change to elevator D, eight meters to the left, arriving in twenty-two seconds. For the other group(s) of interchange passengers in the feeder elevator the information can, for example, be: destination floor S56, change to elevator F, six meters to the right, arriving in thirty-six seconds.

All passengers from the feeder elevator board a limited number of different connecting elevators. The stopping process of the feeder elevator, and the approach distance to the respective connecting elevator, are included in the selection of the connecting elevator, as a result of which the interchange process is optimized.

A further cause of problems with solutions according to the state of the art is grouping of slower passengers with faster passengers when changing, since, for example on the interchange floor, a special status, for example a "handicapped call", has to be input. With the proposed new solution all important attributes of every passenger are already automatically taken into account since the first and only necessary destination-call is input on the boarding floor S1. For slower passengers who identify themselves to the multigroup control MGS with a special status via a special "handicapped button" or, for example, via a card reader, a longer time needed for changing is taken into account.

The changing passengers from, for example, two feeder elevators can, under certain circumstances, be allocated to the same connecting elevator if the connecting elevator is the best elevator for the respective changing passengers from both feeder elevators. The corresponding evaluation of the interchange problem described above is continuously performed by the interchange control unit USE which continuously communicates with the multigroup control MGS and affects the allocation of elevators to the individual trip destinations depending on need and operating mode and adapts the limiting parameters "AZ1MAX", "AZ2MAX", and "AZ3MAX" if necessary. The result is an optimal travel time for the passengers and an optimal process execution for the operator.

It should be noted that all (interchange) trips are possible not only from "below" to "above" but also in the opposite direction.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of controlling an elevator installation operated with zoning and a changing of elevators at an interchange floor comprising:

a) providing at least one feeder-elevator group for transportation to and from the interchange floor, the at-least one feeder-elevator group including a first plurality of feeder elevators which travel in a first zone of floors on one side of the interchange floor and to the interchange floor;

b) providing at least one connecting-elevator group for transportation to and from the interchange floor, the at-least one connecting-elevator group including a second plurality of connecting elevators which travel in a second zone of floors on an opposite side of the interchange floor from the first zone and to the interchange floor;

c) entering a trip destination via a destination-call input;

d) allocating the entered trip destination to one of the feeder elevators depending upon at least one of a number of previously allocated trip destinations of each of the feeder elevators in the first zone and a number of previously allocated trip destinations in the second zone of each of the feeder elevators; and e) controlling the at least one feeder-elevator group and the at least one connecting-elevator group with a multigroup control to serve the entered trip destination.

2. The method according to claim 1 including performing said step d) by allocation to one of the feeder elevators having a number of passengers with different trip destinations in the first zone less than a predetermined maximum number.

3. The method according to claim 2 wherein the number of passengers includes the entered trip destination.

4. The method according to claim 1 including performing said step d) by allocation to one of the feeder elevators having a number of passengers changing zones less than a predetermined maximum number.

5. The method according to claim 4 wherein the number of passengers includes the entered trip destination.

6. The method according to claim 1 wherein said step d) is performed by comparing for each of the feeder elevators a number of associated intermediate stops between a boarding floor and the interchange floor with a parameter representing a maximum number of intermediate stops and allocating the entered trip destination to a one of the feeder elevators having the number of associated intermediate stops less than the parameter.

7. The method according to claim 6 wherein the entered trip destination is allocated to the one feeder elevator that has reached the maximum number of intermediate stops only if the entered trip destination relates to a floor that is already booked and a maximum transportation capacity of the one feeder elevator is not exceeded.

8. The method according to claim 1 wherein said step d) is performed by comparing for each of the feeder elevators a number of associated passengers with different trip destinations in the second zone with a parameter representing a maximum number of different trip destinations in the second zone and allocating the entered trip destination to a one of the feeder elevators having the number of different trip destinations in the second zone less than the parameter.

9. The method according to claim 1 including limiting a number of allocatable ones of the connecting elevators at the interchange floor by a parameter representing a maximum number of allocatable connecting elevators less than a total number of the connecting elevators.

10. The method according to claim 1 including a step of comparing for each of the connecting elevators a number of associated destinations with a parameter representing a maximum number of destinations and allocating the entered trip destination to one of the connecting elevators having the number of associated destinations less than the parameter.

11. The method according to claim 1 including a step of generating a special status signal to the multigroup control for controlling with one of a longer interchange time and a shorter interchange time for a passenger associated with the entered trip destination.

12. The method according to claim 1 including a step of signaling in the one feeder elevator a one of the connecting elevators selected to serve the entered trip destination.

13. The method according to claim 1 wherein said step d) includes allocating the entered trip destination to one of the connecting elevators and performing the allocations based upon cost rules.

14. The method according to claim 1 wherein said step d) is performed by comparing the numbers to parameters representing maximum numbers and the multigroup control changes the parameters based upon on predetermined operating modi.

15. An elevator installation having at least two elevator groups and a destination-call control comprising:

at least one feeder-elevator group with a first plurality of feeder elevators traveling to floors in a first zone of a building;

at least one connecting-elevator group with a second plurality of connecting elevators traveling to floors in a second zone of the building, said elevator groups both traveling to at least one common interchange floor of the building;

a third plurality of display devices for indicating one of said elevators to be selected; and a multigroup control connected to operate said elevators and being responsive to a first destination-call input for selecting a lowest-cost one of said feeder elevators depending on at least one of a first parameter representing a maximum number of trip destinations for said feeder elevators in said first zone and a second parameter representing a maximum number of trip destinations for said feeder elevators in said second zone.

16. The elevator installation according to claim 15 wherein said multigroup control selects a one of said connecting elevators based upon a third parameter representing a maximum number of trip destinations for said connecting elevators in said second zone.

17. The elevator installation according to claim 15 wherein said connecting elevators also travel to destinations below the interchange floor.

18. The elevator installation according to claim 15 wherein said multigroup control limits said connecting elevators allocatable at the interchange floor based upon another parameter representing a maximum allocatable number.

* * * * *